US006416942B1

(12) United States Patent
Sasaki et al.

(10) Patent No.: US 6,416,942 B1
(45) Date of Patent: Jul. 9, 2002

(54) SILVER HALIDE PHOTOGRAPHIC LIGHT-SENSITIVE MATERIAL

(75) Inventors: Hiroki Sasaki; Masatoshi Nakanishi, both of Minami-ashigara (JP)

(73) Assignee: Fuji Photo Film Co., Ltd., Minami-ashigara (JP)

( * ) Notice: Subject to any disclaimer, the term of this patent is extended or adjusted under 35 U.S.C. 154(b) by 92 days.

(21) Appl. No.: 09/670,271

(22) Filed: Sep. 27, 2000

(30) Foreign Application Priority Data

Sep. 27, 1999 (JP) ..... 11-273263

(51) Int. Cl.[7] ..... G03C 1/08; G03C 7/26; G03C 7/32

(52) U.S. Cl. ..... 430/546; 430/510; 430/517; 430/522; 430/631; 430/634; 430/531

(58) Field of Search ..... 430/546, 510, 430/517, 522, 531, 631, 634

(56) References Cited

U.S. PATENT DOCUMENTS 5,278,037 A 1/1994 Karino
5,665,528 A 9/1997 Wariishi et al.

FOREIGN PATENT DOCUMENTS

JP 11143020 A 5/1999

*Primary Examiner*—Geraldine Letscher
(74) *Attorney, Agent, or Firm*—Birch, Stewart, Kolasch & Birch, LLP

(57) ABSTRACT

There is disclosed a silver halide photographic light-sensitive material which comprises a support and provided thereon at least one light-sensitive silver halide emulsion layer and at least one hydrophilic colloidal layer comprising a solid particle dispersion of a water-insoluble photographically useful compound, said solid particle dispersion being a dispersion comprising both a water-insoluble photographically useful compound of the formula 1 and a specific polymer having a carboxyl group and an alkoxycarbonyl group:

formula 1

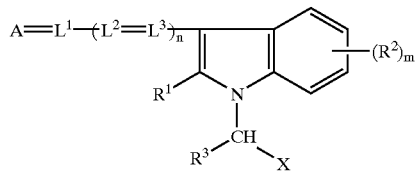

wherein A is an acidic nucleus, $L^1$, $L^2$ and $L^3$ each are a methine group which may be substituted, $R^1$ and $R^3$ each are a hydrogen atom or a substituent (including an atom), $R^2$ is a substituent (including an atom), n is 0 or 1, m is an integer of 0 to 4, when m is an integer of 2 to 4, $R^2$ may be the same or different, X is an electron-withdrawing group having Hammett's substitution constant σm of 0.3 to 1.5. The light-sensitive material is a photographic element that allows a water-insoluble photographically useful material to be stably introduced into photographic elements for various uses, that allows the material to quite stably exist in the photographic element, and that a surfactant having substantially no adverse effect is used therein.

10 Claims, No Drawings

SILVER HALIDE PHOTOGRAPHIC LIGHT-SENSITIVE MATERIAL

FIELD OF THE INVENTION

The present invention relates to a silver halide photographic light-sensitive material, in particular to a silver halide photographic light-sensitive material having a hydrophilic colloidal layer containing a compound that is able to improve stability of solid particle dispersion of fine particles comprising a water-insoluble photographically useful material.

BACKGROUND OF THE INVENTION

In the field of silver halide photography, various kinds of photographically useful compounds are incorporated in a hydrophilic colloidal layer, to thereby attain various kinds of photographic effects/functions. Photographic elements, such as a light-sensitive material and an image-receiving material, are constructed by using such a hydrophilic colloidal layer. As a method of introducing a photographically useful material into the hydrophilic colloidal layer, a solid particle dispersion method can be used in the case where the photographically useful material is insoluble in water. This is a method of preparing a dispersion, and the method comprises finely dispersing the material in the state of solid fine particles in water or a protective colloidal liquid, by, for example, a mill, to obtain a solid particle dispersion, and then adding the resultant solid particle dispersion to a coating solution. Hitherto, as a dispersant or dispersion aid, various kinds of surfactants are used. For example, as a low molecular weight surfactant, known surfactants and compounds described in, for example, JP-A-52-92716 ("JP-A" means unexamined published Japanese patent application) and International publication WO 88/04794 may be used. Further, as an anionic high molecular weight or nonionic high molecular weight surfactant, known compounds and synthetic polymers may also be used. For example, polymers described in JP-A-4-324858 can be used.

However, each of the surfactants for use in the conventional photographic elements is necessary to be properly selected in accordance with the purpose of use or an intended effect. Further, even though a surfactant is selectively used, the stability of a solution or dispersion of the photographically useful material is not sufficient. Consequently, sometimes deposition or aggregation of the dispersion occurs, and deposition or bleeding is caused during storage of a photographic element with the lapse of time. Further, considerably large amount of surfactant is sometimes necessary to be used in accordance with the purpose of use. As a result, adverse side effects occur, such as stickyness, deterioration of the stability of a raw photographic element (hereinafter referred to as "raw storability"), adhesion defect, defects due to diffusion of an additive through layers (color mixing, deterioration with the lapse of time, etc.), deterioration of coating characteristics, and the like.

Further, there is a demand that dispersion particles of a water-insoluble photographically useful material be rendered more finer particles, in order to make a more thinner layer and/or to improve reactivity. Moreover, even though an aqueous coating solution is applied thereon, it is sometimes necessary to render the surface of the layer hydrophobic, in order to give adhesion-resistance or to prevent adhesion of water onto the surface. Further, in order to achieve the above purposes, improvement of the water-insoluble photographically useful materials per se has been performed. JP-A-8-50345 for instance describes a dyestuff compound that gives no chemically adverse affect to a photographic emulsion, that is able to dye only a specific layer in the photographic light-sensitive material and does not diffuse to another layer, that is rapidly decolored and/or dissolved away from the layer at the time of development processing and consequently does not remain in the photographic light-sensitive material, and that has excellent absorption characteristics. However, it is difficult to say that the above-described dyestuff is totally satisfactory, from the overall view points.

SUMMARY OF THE INVENTION

An object of the present invention is to provide a photographic element that allows a water-insoluble photographically useful material to be stably introduced into the photographic element for various uses and further that allows the material to quite stably exist in the photographic element, and furthermore that a surfactant having substantially no adverse effect is used therein. Further, another object of the present invention is to provide a photographic element using a macromolecule (dispersant) which enables to render a dispersion of a water-insoluble photographically useful material to more finer particles thereof.

Other and further objects, features, and advantages of the invention will appear more fully from the following description.

DETAILED DESCRIPTION OF THE INVENTION

The above objects were attained by the following means.

(1) A silver halide photographic light-sensitive material, comprising a support and provided thereon at least one light-sensitive silver halide emulsion layer and at least one hydrophilic colloidal layer comprising a solid particle dispersion of a water-insoluble photographically useful compound, said solid particle dispersion being a dispersion comprising both a water-insoluble photographically useful compound represented by formula 1 and a polymer represented by formula 2:

formula 1

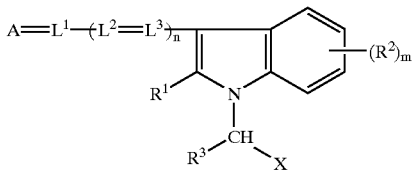

wherein, in formula 1, A represents an acidic nucleus; $L^1$, $L^2$ and $L^3$ each represent a methine group which may be substituted; $R^1$ and $R^3$ each represent a hydrogen atom or a substituent (including an atom), $R^2$ represents a substituent (including an atom), n represents 0 or 1, m represents an integer of 0 to 4, and when m is an integer of 2 to 4, $R^2$'S may be the same or different; and x represents an electron-withdrawing group having a Hammett's substitution constant $\sigma_m$ of 0.3 to 1.5;

formula 2

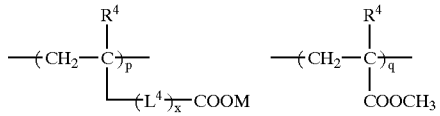

-continued

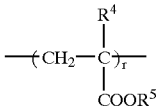

wherein, in formula 2, $R^4$'s each independently represent a hydrogen atom, or an alkyl group having 1 to 6 carbon atoms, $R^5$ represents a substituted or unsubstituted alkyl group having 2 to 18 carbon atoms, a substituted or unsubstituted aralkyl group having 7 to 12 carbon atoms, or a substituted or unsubstituted aryl group having 6 to 18 carbon atoms, $L^4$ represents a divalent linking group, x represents 0 or 1, M represents a monovalent cationic group, p represents 2 to 90% by weight, q represents 5 to 50% by weight, and r represents 0 to 50% by weight, with the proviso that p+q+r=100 (wt %).

(2) The silver halide photographic light-sensitive material according to the above (1), wherein said solid particle dispersion is a solid particle dispersion in which, after dispersing the water-insoluble photographically useful compound represented by formula 1, the polymer represented by formula 2 is added thereto.

(3) The silver halide photographic light-sensitive material according to the above (2), wherein said solid particle dispersion is a solid particle dispersion in which, after dispersing the water-insoluble photographically useful compound with a polymer represented by formula 3, the polymer represented by formula 2 is added thereto:

formula 3

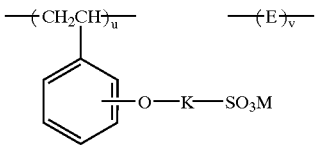

wherein K represents a divalent aliphatic linking group having 1 to 50 carbon atoms, M represents a monovalent cationic group, E represents a repeating unit derived from a copolymerizable ethylenically unsaturated monomer, u represents 5 to 100 mol %, and v represents 0 to 95 mol %.

The formula (2) or (3) by which the copolymers for use in the present invention are represented, shows each of constitutional units and constitutional ratio thereof, and these formulae should not be construed as being limiting a polymerization form of each of the constitutional units to a block copolymer, a random copolymer, and the like.

In formula 1, the compound to give the acidic nucleus group represented by A is preferably 5-pyrazolone, isooxazolone, barbituric acid, thiobartituric acid, pyrazolopyridone, rhodanine, hydantoine, thiohydantoine, oxazolidinedione, pyrazolidinedione, indanedione, hydroxypyridone, 1,2,3,4-tetrahydroquinoline-2,4-dione, or 3-oxo-2,3-dihydrobenzo[d]thiophene-1,1-dioxide, more preferably 5-pyrazolone, hydroxypyridone, pyrazolopyridone, barbituric acid, or isooxazolone, and especially preferably 5-pyrazolone.

The group A has preferably at least one carboxyl group.

Examples of the electron-withdrawing group having the Hammett's substituent constant $\sigma_m$ (that is described, for example, in Chem. Rev., 91, 165 (1991)) of 0.3 to 1.5, which is represented by X, include a halogen atom (e.g., fluorine($\sigma_m$ value=0.34, the figures in parentheses shown below mean the $\sigma_m$ value), chlorine(0.37), bromine(0.39), iodine(0.35)), a trifluoromethyl group (0.43), a cyano group (0.56), a formyl group (0.35), an acyl group (e.g., acetyl (0.38)), an acyloxy group (e.g., acetoxy (0.39)), a carboxyl group (0.37), an alkoxycabonyl group (e.g., methoxycarbonyl(0.37)), an aryloxycarbonyl group (e.g., phenoxycarbonyl (0.37)), an alkylcarbamoyl group (e.g., methylcarbamoyl (0.35)), a nitro group (0.71), an alkylsulfinyl group (e.g., methylsulfinyl(0.52)), an alkylsulfonyl group (e.g., methylsulfonyl(0.60)), and a sulfamoyl group (0.53). The electron-withdrawing group is preferably an alkoxycarbonyl group or a cyano group, and more preferably an alkoxycabonyl group.

The methine group represented by each of $L^1$, $L^2$ and $L^3$ may have a substituent (e.g., a methyl group, an ethyl group, a cyano group, a halogen atom), but it is preferably unsubstituted. Further, n is preferably 0.

Examples of the group represented by $R^1$, $R^2$, or $R^3$, as the substituent other than hydrogen atom, include a substituted or unsubstituted alkyl group having 1 to 8 carbon atoms (e.g., methyl, ethyl, propyl, isopropyl, n-butyl, isobutyl, sec-butyl, t-butyl, cyclohexyl, methoxyethyl, ethoxyethyl, ethoxycarbonylmethyl, ethoxycarbonylethyl, cyanoethyl, diethylaminoethyl, hydroxyethyl, chloroethyl, acetoxyethyl, etc.), a substituted or unsubstituted aralkyl group having 7 to 12 carbon atoms (e.g., benzyl, 2-carboxybenzyl, etc.), a substituted or unsubstituted aryl group having 6 to 18 carbon atoms (e.g., pheny, 4-methylphenyl, 4-methoxyphenyl, 4-carboxyphenyl, 3,5-dicarboxyphenyl, etc.), a substituted or unsubstituted acyl group having 2 to 6 carbon atoms (e.g., acetyl, propionyl, butanoyl, chloroacetyl, etc.), a substituted or unsubstituted sulfonyl group having 1 to 8 carbon atoms (e.g., methanesulfonyl, p-toluenesulfonyl, etc.), a substituted or unsubstituted alkoxycarbonyl group having 2 to 6 carbon atoms (e.g., methoxycarbonyl, ethoxycarbonyl, etc.), a substituted or unsubstituted alkoxy group having 1 to 4 carbon atoms (e.g., methoxy, ethoxy, n-butoxy, methoxyethoxy, etc.), a substituted or unsubstituted aryloxy group having 6 to 10 carbon atoms (e.g., phenoxy, 4-methoxyphenoxy, etc.), a substituted or unsubstituted acyloxy group having 2 to 8 carbon atoms (e.g., acetoxy, ethylcarbonyloxy, cyclohexylcarbonyloxy, benzoyloxy, chloroacetyloxy, etc.), a substituted or unsubstituted sulfonyloxy group having 1 to 6 carbon atoms (e.g., methanesulfonyloxy, etc.), a substituted or unsubstituted carbamoyloxy group having 2 to 8 carbon atoms (e.g., methylcarbamoyloxy, diethylcarbamoyloxy, etc.), a substituted or unsubstituted amino group having 0 to 8 carbon atoms (e.g., amino, methylamino, dimethylamino, diethylamino, phenylamino, methoxyphenylamino, chlorophenylamino, morpholino, piperidino, pyrrolidino, pyridylamino, methoxycarbonylamino, n-butoxycarbonylamino, phenoxycarbonylamino, methylcarbamoylamino, phenylcarbamoylamino, acetylamino, ethylcarbonylamino, cyclohexylcarbonylamino, benzoylamino, chloroacetylamino, methylsulfonylamino, etc.), a substituted or unsubstituted carbamoyl group having 1 to 8 carbon atoms (e.g., unsubstituted carbamoyl, methylcarbamoyl, ethylcarbamoyl, n-butylcarbamoyl, t-butylcarbamoyl, dimethylcarbamoyl, morpholinocarbamoyl, pyrrolidinocarbamoyl, etc.), a substituted or unsubstituted sulfonamido group having 1 to 8 carbon atoms (e.g., methanesulfonamido, p-toluenesulfonamido, etc.), a halogen atom (e.g., fluorine, chlorine, bromine), a hydroxyl group, a nitro group, a cyano group, and a carboxyl group.

$R^1$ is preferably a hydrogen atom, or a group selected from the group consisting of an alkyl group, an aryl group, an alkoxycarbonyl group, and an aryloxycarbonyl group, and especially preferably a hydrogen atom.

m is preferably 0, 1 or 2. When m is 1 or 2, $R^2$ is preferably selected from the group consisting of an alkyl group, an aryl group, an amino group, an alkoxy group, an acyloxy group, a carbamoyl group, a halogen atom, a nitro group, and an carbonyl group. m is especially preferably 0.

$R^3$ is preferably a halogen atom, or selected from the group consisting of an alkyl group and an aryl group, and especially preferably an alkyl group.

A preferable embodiment is a combination in which the acidic nucleus represented by A is one derived from 5-pyrazolone, hydroxypyridone, pyrazolopyridone, barbituric acid, or isooxazolone; n=0; m=0; $R^1$ is a hydrogen atom; $R^3$ is a hydrogen atom or an alkyl group; and X is an alkoxycarbonyl group or a cyano group. An especially preferable embodiment is a combination in which the acidic nucleus represented by A is 5-pyrazolone; n=0; m=0; $R^1$ is a hydrogen atom; $R^3$ is an alkyl group; and X is an alkoxycarbonyl group.

Specific examples of the compound represented by formula 1 are shown below, but the present invention should not be construed as being limited thereto.

D-1

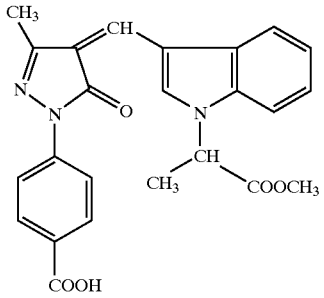

D-2

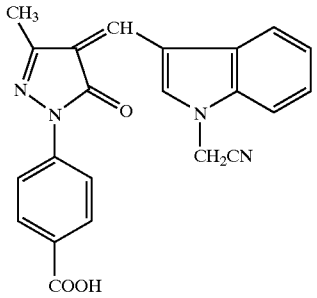

D-3

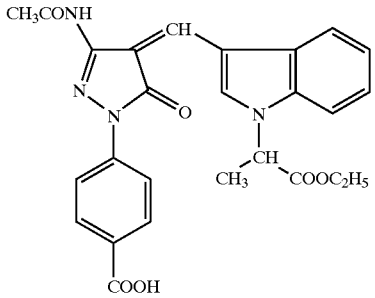

-continued

D-4

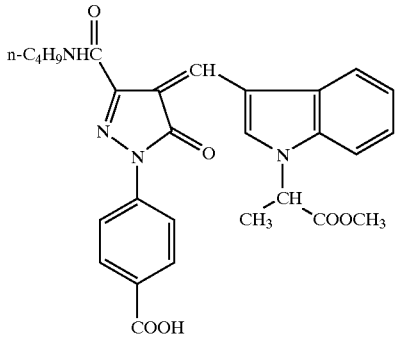

D-5

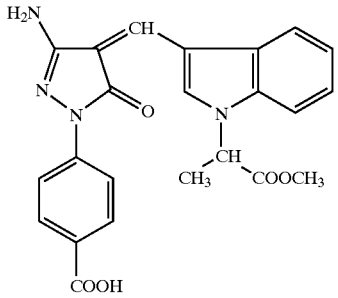

D-6

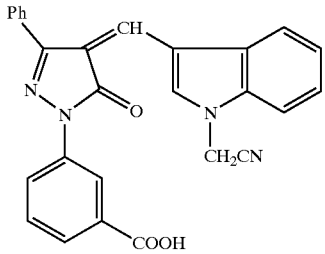

D-7

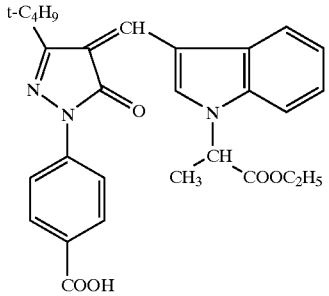

D-8

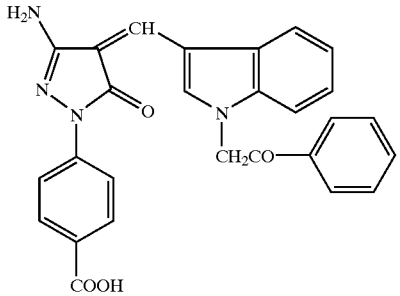

-continued

D-9

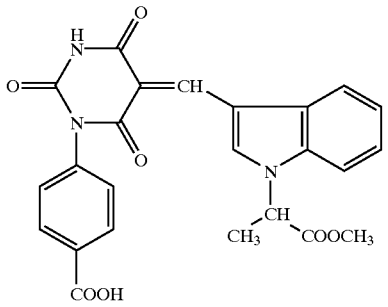

D-10

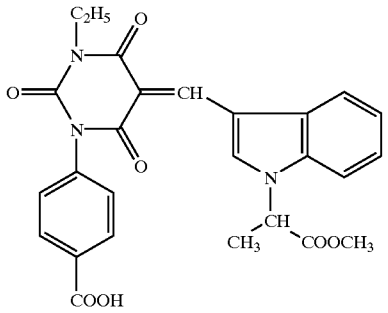

D-11

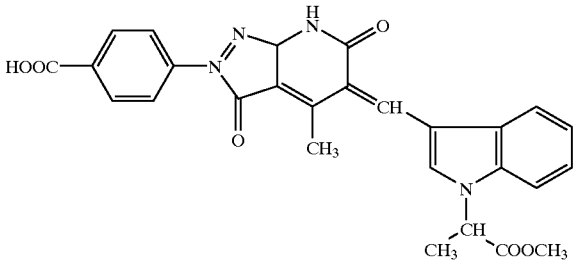

D-12

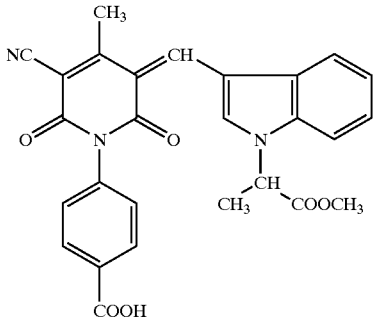

The polymer represented by formula 2 is explained as follows. $R^4$ represents a hydrogen atom, or a substituted or unsubstituted alkyl group having 1 to 8 carbon atoms (e.g., methyl, ethyl, propyl, isopropyl, n-butyl, n-hexyl). Among these atom or groups, especially preferred are a hydrogen atom and a methyl group.

$R^5$ represents a substituted or unsubstituted alkyl group having 2 to 8 carbon atoms (e.g., ethyl, propyl, isopropyl, n-butyl, n-hexyl, n-octyl, t-octyl, 2-ethylhexyl, n-nonyl, isononyl, lauryl, stearyl, 2-hydroxyethyl, methoxymethyl, methoxyethyl, n-butoxymethyl, ethoxymethyl, ethoxybutyl, etc.), a substituted or unsubstituted aralkyl group having 7 to 12 carbon atoms (e.g., benzyl, 2-carboxybenzyl, etc.), or a substituted or unsubstituted aryl group having 6 to 18 carbon atoms (e.g., pheny, 4-methylphenyl, 4-methoxyphenyl, 4-carboxyphenyl, 3,5-dicarboxyphenyl, etc.). Among these groups, the alkyl group is preferably n-butyl, n-hexyl, n-octyl, n-nonyl, lauryl, and 2-hydroxyethyl groups; the aralkyl group is preferably a benzyl group; the aryl group is preferably phenyl, 4-methylphenyl, and 4-methoxyphenyl groups. $R^5$ is more preferably n-butyl, n-hexyl, n-octyl, 2-hydroxyethyl, benzyl, and phenyl groups. As $R^5$'s, two or more kinds of groups may be selected from these groups.

$L^4$ represents a divalent linking group. Specific examples thereof include $—COOCH_2CH_2—$, $—CONHCH_2CH_2CH_2—$, $—CONHCH_2CH_2CH_2CH_2CH_2—$, and $—CONHC_6H_4—$. Among these groups, $—COOCH_2CH_2—$ is most preferred.

x represents 0 or 1. x is preferably 0.

M represents a monovalent cation. Specific examples thereof include hydrogen, sodium, potassium, lithium, and ammonium cations. Among these cations, a sodium cation is most preferred.

The polymer represented by formula 2 according to the present invention may be constructed of the above-described repeating units alone, but, if desired, other ethylenically unsaturated monomer may be further copolymerized with the polymer. Examples of the other ethylenically unsaturated monomer include styrene, α-methylstyrene, acrylonitrile, acrylamide, N-vinylpyrolidone, and dimethylacrylamide. Among these monomers, styrene is most preferred. The constitutional proportion of the ethylenically unsaturated monomer component is generally less than 10 wt %.

p represents a value in the range of 2 to 90% by weight, q represents a value in the range of 5 to 80% by weight, and r represents a value in the range of 0 to 60% by weight.

Preferably, p is 2 to 85% by weight, q is 5 to 75% by weight, and r is 0 to 55% by weight. More preferably, p is 2 to 80% by weight, q is 5 to 70% by weight, and r is 0 to 50% by weight.

To prepare the polymer of formula 2, a known polymerization method may be used, but for an industrial use, a radical solution polymerization is preferably carried out. As a polymerization initiator, known azo-series or peroxide-series polymerization initiator may be used to polymerize. Examples of the azo-series or peroxide-series polymerization initiator include both the compounds soluble in water and the compounds soluble in an oil. Specific examples of the water-soluble azo compound include azoamide compounds, such as 2,2'-azobis-(2-methylpropioneamidine) hydrochloride, 2,2'-azobis-[(2-(2-imidazoline-2-yl)propane] hydrochloride, and 2,2'-azobis-(2-methylpropionic acid amide) dihydrate, etc., and 4,4'-azobis-(4-cyanopentanoic acid). Specific examples of the oil-soluble azo compound include 2,2'-azobisisobutyronitrile, 2,2'-azobisisobutylvaleronitrile, 4,4'-azobis-(4-cyanopentanoic acid), and dimethyl-2,2'-azobisisobutyrate, etc. Specific examples of the water-soluble peroxide include ammonium persulfate and potassium persulfate. Specific examples of the oil-soluble peroxide include benzoyl peroxide.

The amount of the above polymerization initiator may be used without any particular limitation, but it is generally in the range of 0.05 to 5% by weight, preferably in the range of 0.1 to 2% by weight, based on 100% by weight of monomers. If the amount is too small, there is a possibility that unreacted monomers remain. On the other hand, if the amount is too large, it is industrially unpreferable.

Further, the concentration of monomers in a reaction solution at the time of polymerization is generally in the range of 20 to 60% by weight, and preferably in the range of 30 to 50% by weight.

The molecular weight of the polymer which can be obtained by a production method according to the present invention, is a weight-average molecular weight (Mw) of generally 1,000 to 200,000, preferably 1,500 to 150,000, and more preferably 2,000 to 100,000. The molecular weight can be easily measured by gel permeation chromatography (GPC) using a standard substance.

The polymer which can be obtained by a production method according to the present invention, may be used in the state as it is, but it is preferable to use the polymer in which a part of, or all of carboxylic acid groups are neutralized with ammonia or an organic amine. The thus-produced polymers are soluble or dispersible in water. As to neutralization, salts of the polymer are preferably produced by neutralizing a part of or all of carboxylic acid groups in the polymer with ammonia or an alkali metal hydroxide and adjusting the pH value to the range of 5 to 10.

Specific examples of the alkali metal hydroxide include sodium hydroxide, potassium hydroxide, and the like. Among these compounds, sodium hydroxide and potassium hydroxide are preferably used for neutralization. Sodium hydroxide is most preferred.

Further, in the case where a polymer obtained by a production method according to the present invention is used for the present invention, any one of the polymer containing a solvent, or a water dispersion of the polymer, or an aqueous solution of the polymer, from which a solvent (organic solvent) is removed, may be used. It is preferable to remove the solvent.

Specific examples of the polymer represented by formula 2 are shown below, but the present invention should not be construed as being limited thereto. The molecular weight is shown by a weight-average molecular weight measured by a usual method.

B-1

$-(CH_2CH)_{85}-$ ($COOCH_3$) $-(CH_2CH)_{15}-$ ($COONa$) (wt %) Mw 8800

(Mw represents weight-average molecular weight)

B-2

$-(CH_2CH)_{90}-$ ($COOCH_3$) $-(CH_2CH)_{10}-$ ($COONa$) (wt %) Mw 9200

B-3

$-(CH_2CH)_{10}-$ ($COO-{}_nC_4H_9$) $-(CH_2CH)_{70}-$ ($COOCH_3$) $-(CH_2CH)_{20}-$ ($COONa$) (wt %) Mw 8500

B-4

$-(CH_2CH)_{10}-$ ($COO-{}_nC_4H_9$) $-(CH_2CH)_{75}-$ ($COOCH_3$) $-(CH_2CH)_{15}-$ ($COONa$) (wt %) Mw 9000

B-5

$-(CH_2CH)_{20}-$ ($COO-{}_nC_4H_9$) $-(CH_2CH)_{60}-$ ($COOCH_3$) $-(CH_2CH)_{20}-$ ($COONa$) (wt %) Mw 12000

B-6

$-(CH_2CH)_{10}-$ ($COO-{}_nC_6H_{13}$) $-(CH_2CH)_{70}-$ ($COOCH_3$) $-(CH_2CH)_{20}-$ ($COONa$) (wt %) Mw 10000

B-7

$-(CH_2CH)_{5}-$ ($COO-{}_nC_6H_{13}$) $-(CH_2CH)_{80}-$ ($COOCH_3$) $-(CH_2CH)_{15}-$ ($COONa$) (wt %) Mw 7000

-continued

B-8

$-(CH_2CH)_{10}-$ ($COO-{}_nC_4H_9$) $-(CH_2CH)_{70}-$ ($COOCH_3$) $-(CH_2CH)_{20}-$ ($COOCH_2CH_2COONa$) (wt %) Mw 8800

B-9

$-(CH_2CH)_{10}-$ ($COO-{}_nC_6H_{13}$) $-(CH_2CH)_{70}-$ ($COOCH_3$) $-(CH_2CH)_{20}-$ ($COOCH_2CH_2COONa$) (wt %) Mw 9800

B-10

$-(CH_2CH)_{10}-$ ($COO-{}_nC_8H_{17}$) $-(CH_2CH)_{70}-$ ($COOCH_3$) $-(CH_2CH)_{20}-$ ($COONa$) (wt %) Mw 11000

B-11

$-(CH_2CH)_{5}-$ ($COO-{}_nC_{11}H_{25}$) $-(CH_2CH)_{75}-$ ($COOCH_3$) $-(CH_2CH)_{20}-$ ($COONa$) (wt %) Mw 9300

B-12

$-(CH_2CH)_{10}-$ ($COOCH_2$-C$_6$H$_5$) $-(CH_2CH)_{75}-$ ($COOCH_3$) $-(CH_2CH)_{15}-$ ($COONa$) (wt %) Mw 8400

B-13

$-(CH_2CH)_{10}-$ ($COO-{}_nC_4H_9$) $-(CH_2CH)_{10}-$ ($COOCH_2CH_2OH$) $-(CH_2CH)_{30}-$ ($COOCH_3$) $-(CH_2CH)_{50}-$ ($COONa$) (wt %) Mw 14000

B-14

$-(CH_2CH)_{5}-$ ($COO-{}_nC_6H_{13}$) $-(CH_2CH)_{10}-$ ($COOCH_2CH_2OH$) $-(CH_2CH)_{30}-$ ($COOCH_3$) $-(CH_2CH)_{55}-$ ($COONa$) (wt %) Mw 9000

B-15

$-(CH_2CH)_{10}-$ ($COO-{}_nC_8H_{17}$) $-(CH_2CH)_{30}-$ ($COOCH_2CH_2OH$) $-(CH_2CH)_{30}-$ ($COOCH_3$) $-(CH_2CH)_{30}-$ ($COONa$) (wt %) Mw 6000

B-16

$-(CH_2CH)_{10}-$ ($COO-{}_nC_{11}H_{25}$) $-(CH_2CH)_{30}-$ ($COOCH_2CH_2OH$) $-(CH_2CH)_{35}-$ ($COOCH_3$) $-(CH_2CH)_{25}-$ ($COONa$) (wt %) Mw 7600

B-17

$-(CH_2CH)_{10}-$ ($COOCH_2$-C$_6$H$_5$) $-(CH_2CH)_{30}-$ ($COOCH_2CH_2OH$) $-(CH_2CH)_{45}-$ ($COOCH_3$) $-(CH_2CH)_{35}-$ ($COONa$) (wt %) Mw 9000

B-18

$-(CH_2CH)_{5}-$ (C$_6$H$_5$) $-(CH_2CH)_{15}-$ ($COOCH_2CH_2OH$) $-(CH_2CH)_{20}-$ ($COOCH_3$) $-(CH_2CH)_{60}-$ ($COONa$) (wt %) Mw 8700

-continued

B-19

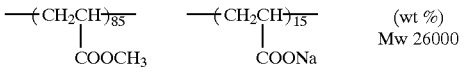

B-20

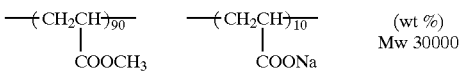

B-21

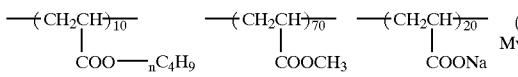

B-22

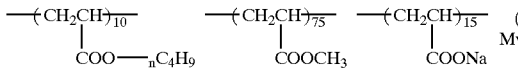

B-23

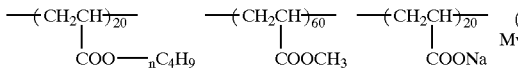

B-24

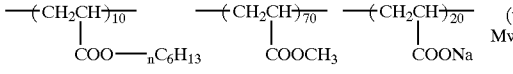

B-25

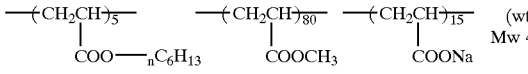

B-26

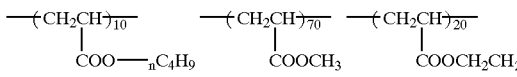

(wt %)
Mw 51000

B-27

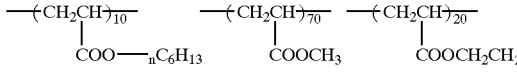

(wt %)
Mw 53000

B-28

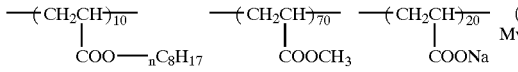

B-29

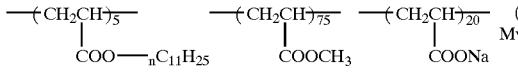

B-30

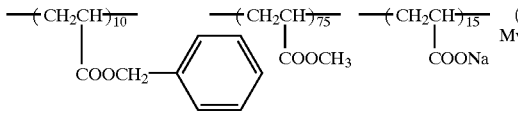

The polymer represented by formula 3 is explained below.

In formula 3, K represents a divalent aliphatic linking group having 1 to 50 carbon atoms. Specific examples of the linking group include a propylene group, a butylene group, an alkyleneoxy group, a polyalkyleneoxy group, and an alkylene-alkyleneoxy group. Among these groups, a butylene group is most preferred. M represents a monovalent cation group. Specific examples thereof include cations of hydrogen, sodium, potassium, lithium, and ammonium. Among these cations, a sodium cation is most preferred. E represents a unit of a copolymerizable ethylenically unsaturated monomer other than the above-described monomer units. Among these, most preferred are units derived from styrene or a styrene derivative (e.g., vinyltoluene, acetoxystyrene, t-butoxystyrene, bromostyrene, chlorostyrene, hydroxystyrene). u is a value in the range of 5 to 100 mol %, preferably in the range of 15 to 100 mol %, and more preferably in the range of 20 to 100 mol %. v is a value in the range of 0 to 95 mol %, preferably in the range of 0 to 85 mol %, and more preferably in the range of 0 to 80 mol %. The molecular weight of the polymer represented by formula 3 is a weight-average molecular weight of generally $10^3$ to $10^6$, preferably from $10^3$ to $10^5$, and more preferably from 2,000 to $3\times10^4$.

The compounds for use in the present invention can be synthesized by an ordinary method. The synthesis of a precursor of the polymer and scission of a protecting group can be referred to *Macromolecules,* Vol. 16, p. 510 (1983), and ibid. Vol. 22, p. 509 (1989). Introduction of a sulfonic acid can be referred to *Kogyo Kagaku Zasshi* (*Journal of the Chemical Society of Japan, Industrial Chemical Section*), Vol.73, p. 563 (1970), ibid. Vol. 59, p. 221 (1956), and *J. Am. Chem. Soc.,* Vol. 77, p. 2496 (1955). Further, polymerization of vinyl phenol monomers can be referred to *J. Polym. Sci.,* A-1 Vol.7, p. 2175 (1969), and ibid. p. 2405 (1969). It is more preferable to begin with synthesizing a precursor polymer using a monomer of vinyl phenol whose hydroxyl group is protected with a protecting group, then cleaving the protecting group (for scission), and thereafter introducing a sulfonic acid group. Specifically, the compound for use in the present invention can, for example, be synthesized by the steps of: synthesizing a homopolymer of t-butoxystyrene or a copolymer (precursor polymer) of t-butoxystyrene and styrene, e.g. with radical polymerisation or cationic or anionic polymerisation, cleaving a t-butyl group of the protecting group with trifluoromethanesulfonic acid (for scission), reacting the resultantly formed hydroxyl group with sodium methylate to form a phenolate anion, and thereafter reacting the resultant polymer with butanesultone to introduce a sulfonic acid group.

Specific examples of the compound are shown below. The molecular weight is shown by a weight-average molecular weight (MW) which can be measured by an ordinary method. Among these compounds, Polymer S-3 is most preferred.

S-1

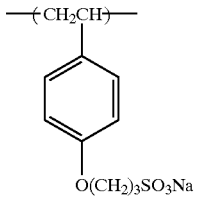

Mw 4800
(Mw represents weight-average molecular weight)

-continued

S-2

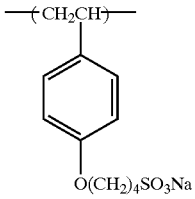

Mw 5500

S-3

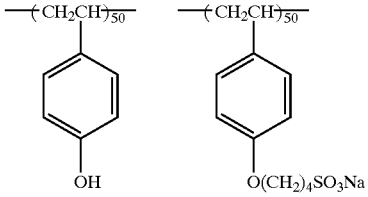

(mol %)
Mw 4500

S-4

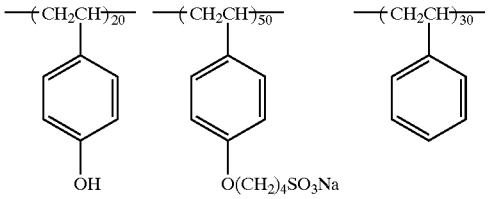

(mol %)
Mw 5400

S-5

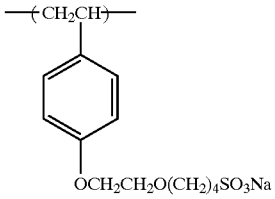

Mw 7400

S-6

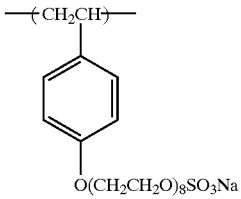

Mw 10000

S-7

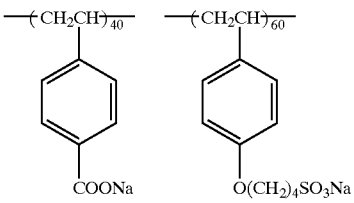

(mol %) Mw 12000

S-8

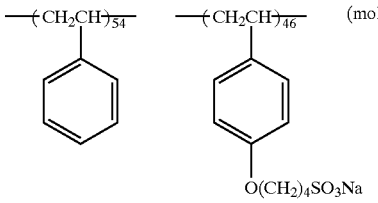

(mol %) Mw 4800

-continued

S-9

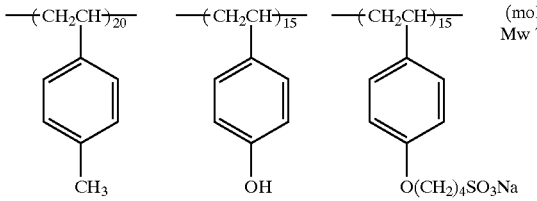

(mol %)
Mw 7100

S-10

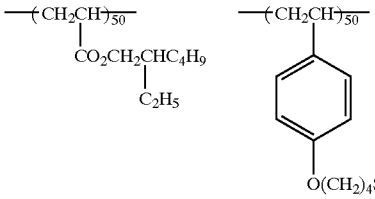

(mol %)
Mw 11000

S-11

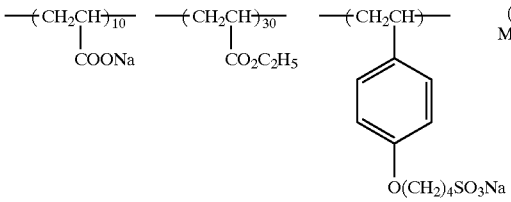

(mol %)
Mw 15000

A dispersion method of preparing a solid particle dispersion which is used in the present invention, is classified into an emulsion dispersion method and a solid particle dispersion method. Even though the dispersion can be prepared by any one of these dispersion methods, the most preferable dispersion method is a solid particle dispersion method, which can be carried out according to a known method. Details of the dispersion method are described in, for example, "*Applied technology of functional pigments*", published by C.M.C. (1991). Among these dispersion methods, a dispersion media method is most preferred. According to the dispersion media method, a powder material or wet cake-like material to be dispersed in the present invention is mixed with a polymer for use in the present invention in water to make an aqueous slurry. Thereafter, the resultant slurry is mechanically ground by means of a known grinder (e.g., a ball mill, a sand mill, a roller mill, a superapex mill, a spike mill, etc.) in the presence of dispersion media (e.g., glass beads, alumina beads, zirconia beads). Of these dispersion media, there can be used beads having an average diameter of preferably lmm to 0.05 mm, more preferably from 0.5 mm to 0.1 mm, and further preferably from 0.3 mm to 0.1 mm. The filling factor is generally 70% or more, and preferably 80% or more. The circuit (round) speed is generally 8 m/s or more, and preferably 10 m/s or more. The temperature is generally 100° C. or less, and preferably 40° C. or less. The work density per real volume in a dispersion container is generally 0.5 kW/l or more, and preferably 2 kW/l or more. In place of the above methods, there can be also used a method for pulverization by means of a roll mill, a homogenizer, a high-pressure homogenizer, a colloid mill, Desolver, or a high speed impeller agitator, or by means of an ultrasonic dispersing machine (e.g., microfluidizer).

In the case where a dispersed solid comprising a combination of compounds according to the present invention is prepared, there can be used two methods, one of which is properly selected in accordance with its purpose and a degree of effects obtained thereby. That is, one is a method of using a polymer represented by formula 2, as a dispersant. Another is a method of preparing a dispersed solid of a water-insoluble photographically useful material represented by formula 1 in the presence of another dispersant, and thereafter adding thereto a polymer represented by formula 2.

First, the former method is explained. In this case, two or more kinds of the above polymer may be used. The amount of the polymer to be used is preferably in the range of 1 wt % to 100 wt %, especially preferably in the range of 2 wt % to 40 wt %, based on the material to be dispersed. Further, if necessary, a low molecular weight surfactant may be added after dispersion. The amount of the surfactant to be used is generally ½ or less, preferably ⅕ or less, and more preferably 1/10 or less, based on the amount of the above polymer.

The latter method is explained. In this case, a dispersed solid of a water-insoluble photographically useful material represented by formula 1 is prepared using a low molecular surfactant, a sulfonic acid-series high molecule, or a nonionic high molecule. Thereafter, the polymer represented by formula 2 for use in the present invention is added. After completing the addition, gentle agitation may be carried out, or alternatively the mixture may be placed again in a dispersing machine to conduct dispersion and agitation for a short period of time.

As a low molecular surfactant, there can be used known surfactants, and compounds described in, for example, JP-A-52-92716 and International publication WO 88/04794. As a sulfonic acid-series high molecule, or a nonionic high molecule, publicly known compounds or synthetic polymers can be used. Among these compounds, sulfonic acid-series low-molecular-weight surfactants or sulfonic acid-series high molecules are preferred, and the sulfonic acid-series high molecule represented by formula 3 is most preferred.

The amount of the above compound to be used is preferably in the range of 1 wt % to 50 wt %, especially preferably in the range of 2 wt % to 30 wt %, based on the material of the formula 1 to be dispersed. As a polymer of the formula 2 to be added thereafter, one or more kinds of the polymer may also be used. The amount of the polymer to be used is preferably in the range of 1 wt % to 100 wt %, especially preferably in the range of 2 wt % to 40 wt %, based on the material to be dispersed.

A water-insoluble photographically useful compound represented by formula 1, which can be used in the present invention, is used in the form of fine particles. For example, when the compound is used in the form of a wet-cake, the particle size is a particle size in a produced wet-cake, and it is generally in the range of 1 to 100 $\mu$m, preferably in the range of 10 to 100 $\mu$m.

Further, the polymers represented by formula 2 or 3 are used as a dispersant or a dispersion aid. They are preferably used in the form of a water-soluble salt. On the other hand, the polymers, which are insoluble in water, may be used in the form of latex having a particle size of 0.05 to 0.5 $\mu$m.

In the case that a dispersed solid of material to be dispersed according to the present invention is incorporated in a silver halide photographic light-sensitive material, the dispersed solid may be added to a layer of the light-sensitive material in an amount required for the purpose of the intended use. Particularly in the case that a material to be dispersed is a compound having a light absorption as that of the formula 1, it is preferable to use the material in such an amount that an optical density is in the range of 0.05 to 3.0. Even though specific amount to be required is different in accordance with the type or kind of compound/material, a preferable amount is generally within the range of $10^{-3}$ g/m$^2$ to 3.0 g/m$^2$, especially in the range of $10^{-3}$ g/m$^2$ to 1.0 g/m$^2$. Further, the dispersed solid for use in the present invention may be incorporated in the light-sensitive material at any position in accordance with the purpose of intended use. That is, the dispersed solid may be added to a hydrophilic colloidal layer, such as an undercoating layer, an antihalation layer between a silver halide emulsion layer and a support, a silver halide emulsion layer, a yellow filter layer, an intermediate layer, a protective layer, a backing layer on the support opposite to the silver halide emulsion layer-coating side, and other auxiliary layers.

If necessary, the solid particle dispersion may be added to a single layer or a plurality of layers, or alternatively a plurality of compounds may be used independently or in combination in a single layer or a plurality of layers.

If necessary, the dispersed solid for use in the present invention may be used in combination with various other water-soluble dyes, water-soluble dyes adsorbed on a mordant, emulsified and dispersed dyes, or dispersed solid dyes produced by a different method from the present invention. As a hydrophilic colloid, gelatin is most preferred, and various kinds of known gelatins can be used. For example, there can be used various gelatins, each of which is produced by a different production method, such as a lime-processed gelatin and an acid-processed gelatin, or chemically modified gelatins of these, such as a phthalated gelatin and a sulfonylated gelatin. Further, if necessary, a desalting-processed gelatin may be used. The mixing ratio of the dispersed solid for use in the present invention to gelatin varies in accordance with the kind, degree of dispersion, and absorbance to be required, of the dispersed solid for use in the present invention, and the amount of gelatin to be used, but the ratio is preferably in the range of $1/10^3$ to 1/3.

Preferable examples of the silver halide photographic light-sensitive material of the present invention include a color reversal film and a color negative film. The silver halide emulsion to be used is generally subjected to physical ripening, chemical ripening, and spectral sensitization. The present invention particularly remarkably exhibits its effects when the emulsion sensitized with both a gold compound and a sulfur-containing compound is used. Additives that can be used in these processes are described in Research Disclosure Nos. 17643 and 18716, and the corresponding passages are listed below.

Known photographic additives that can be used in the present invention are also described in the above-mentioned two Research Disclosures, and involved sections are listed in the same table below.

| | Additive | RD 17643 | RD 18716 |
|---|---|---|---|
| 1 | Chemical sensitizers | p.23 | p.648 (right column) |
| 2 | Sensitivity-enhancing agents | — | p.648 (right Column) |
| 3 | Spectral sensitizers and Supersensitizers | pp.23–24 | pp.648 (right column)–649 (right column) |
| 4 | Brightening agents | p.24 | — |
| 5 | Antifogging agents and Stabilizers | pp.24–25 | p.649 (right column) |

-continued

| Additive | | RD 17643 | RD 18716 |
|---|---|---|---|
| 6 | Light absorbers, Filter dyes, and UV absorbers | pp.25–26 | pp.649 (right column)–650 (left column) |
| 7 | Stain-preventing agents | p.25 (right column) | p.650 (left to right columns) |
| 8 | Image-dye stabilizers | p.25 | — |
| 9 | Hardeners | p.26 | p.651 (left column) |
| 10 | Binders | p.26 | p.651 (left column) |
| 11 | Plasticizers and Lubricants | p.27 | p.650 (left column) |
| 12 | Coating aids and Surfactants | pp.26–27 | p.650 (right column) |

The silver halide photographic light-sensitive material produced by the use of a particular water-insoluble photographically useful compound (a dye compound) and a particular polymer in combination according to the present invention, is excellent in color reproduction, as well as it is improved remarkably in both raw storability and latent image stability.

The present invention is described in more detail with reference to the following examples, but the present invention is not limited thereto.

EXAMPLES

Example 1

A premixing product according to the dispersion formulation as set forth below was prepared. Thereafter, the resultant product was dispersed by means of an agitator mill LMK (manufactured by Ashizawa) to prepare a dispersed solid of dye (D-1) (a dispersion exhibiting the dye concentration of 25 wt %).

| Dispersion Formulation | |
|---|---|
| Wet-cake of dye (D-1) (Solid content 85.0%) | 58.2 g |
| Dispersant(s) | 5 to 18% based on the solid content of dye |
| Water | up to 198 g |

In this formulation, the average particle size of the dispersed dye was in the range of 0.05 to 0.3 μm. Each of dispersants was a water-soluble polymer.

Based on the above formulation, a dispersion method (kind, amount, addition method of the dispersant) was changed as shown in Table 1, to test their physical properties. The results are shown in Table 1. In these tests, absorbance was measured in order to evaluate both the dispersibility and dispersion stability of the dispersed solid. The physical properties were determined by absorbance (absorption maximum wavelength: λ max), degree of dispersion and its change, and sedimentation of dispersion. For the dispersibility, absorbance was measured. The measurement of absorbance (absorption maximum wavelength) was carried out by measuring an absorption spectrum after diluting each of the samples with water to a predetermined concentration. λ max was present at about 440 nm. The results are shown by relative values, assuming that absorbance at the λ max, which is indicated by Dmax, of No. 1 in Table 1 be 100. The degree of dispersion is shown in Table 1, each measuring the ratio in absorbances in the above absorption spectra (i.e., Absorbance at 500 nm/Absorbance at λ max).

The dispersion stability was determined, according to a change (δ) of the degree of dispersion, and the presence of sedimentation. As to the change of the degree of dispersion, firstly absorption spectra of a dispersion exhibiting the dye concentration of 25 wt % before and after the lapse of time for 1 week at 40° C., were each measured in the same manner as above, and then the degree of dispersion (Absorbance at 500 nm/Absorbance at λ max) were each measured. The change of the degree of dispersion was shown by a difference in the degree of dispersion between before and after the lapse of time: δ(change of the degree of dispersion)=Lapse of time(the degree of dispersion)−Flesh (the degree of dispersion). That is, if the dispersion stability deteriorates, the value of degree of dispersion becomes larger, and therefore the difference between before and after the lapse of time becomes larger. The degree of sedimentation was determined by measuring visually the presence of sedimentation after leaving a dispersion with the dye concentration of 25 wt % for 1 month at room temperature.

As a dispersant for comparison, sodium polyacrylate (the polymer having the weight average molecular weight of 10,000 was separately synthesized) and sodium p-octylphenoxyethoxyethoxyethanesulfonate were used (in the table, these salts were inscribed as PAANa, and W-1, respectively).

TABLE 1

| No. | Kind Of Dispersant/amount | Kind of dispersant added later/amount | Dmax | Degree of dispersion | δ (Change of degree of dispersion) | Presence of sedimentation |
|---|---|---|---|---|---|---|
| 1 (Example of this invention) | B-1/20 wt % | None | 100 | 0.21 | 0.02 | None |
| 2 (Example of this invention) | B-4/20 wt % | B-1/5 wt % | 101 | 0.20 | 0.04 | None |
| 3 (Example of this invention) | B-3/20 wt % | PAANa | 99 | 0.21 | 0.03 | None |
| 4 (Example of this invention) | W-1/5 wt % | B-5/10 wt % | 103 | 0.22 | 0.02 | None |
| 5 (Example of this invention) | B-5/15 wt % | W-1/3 wt % | 100 | 0.21 | 0.02 | None |

TABLE 1-continued

| No. | Kind Of Dispersant/amount | Kind of dispersant added later/amount | Dmax | Degree of dispersion | δ (Change of degree of dispersion) | Presence of sedimentation |
|---|---|---|---|---|---|---|
| 6 (Example of this invention) | B-7/20 wt % | None | 102 | 0.20 | 0.03 | None |
| 7 (Example of this invention) | S-4/6 wt % | B-10/18 wt % | 99 | 0.19 | 0.02 | None |
| 8 (Example of this invention) | B-9/20 wt % | W-1/5 wt % | 101 | 0.20 | 0.03 | None |
| 9 (Example of this invention) | B-6/20 wt % | S-4/3 wt % | 104 | 0.18 | 0.04 | None |
| 10 (Comparative example) | PAANa/20 wt % | None | 90 | 0.46 | 0.23 | Present |
| 11 (Comparative example) | W-1/10 wt % | None | 99 | 0.39 | 0.38 | Present |
| 12 (Comparative example) | S-4/8 wt % | None | 99 | 0.21 | 0.04 | None |
| 13 (Comparative example) | S-4/8 wt % | PAANa/10 wt % | 92 | 0.22 | 0.13 | Present slightly |
| 14 (Comparative example) | W-1/10 wt % | PAANa/10 wt % | 85 | 0.35 | 0.17 | Present |

Example 2

Preparation of Organic Solid Dispersed Dye

Compound (D-1) of Example 1 (the same compound as the solid dispersed dye ExF-5 in the 12th layer in an example of JP-A-11-38568) was dispersed by the following method. That is, 4.95 g of a 20% aqueous solution of the dispersant B-1 according to the present invention and 13.5 ml of water were placed in a pot mill of 700 ml. Thereafter, 5.82 g of a wet cake of dye ExF-5 (solid content 85.0%) and 500 ml of zirconium oxide beads (diameter 1 mm) were added, and the content of the mill was dispersed. The period of time for dispersion was regulated so that the degree of dispersion as defined in Example 1 would be 0.42. For the dispersion, a mill of the same apparatus as in Example 1 was used. After dispersion, the content was taken out from the mill, and filtered to remove the beads. To a resultant filtrate, 8 g of a 12.5% aqueous gelatin solution was added, to obtain a gelatin dispersion of the dye.

Preparation of Samples 101 to 105

Multilayer light-sensitive materials 101 to 105 described in Example 1 of JP-A-11-38568 were prepared in the same manner as in the Example 1 of JP-A-11-38568, except that organic solid particle dispersions of dye were prepared by changing a method of dispersing D-1 (kind, amount, addition method, of a dispersant) from No.1 of the above Example 1 (an example of the present invention; see Table 1) to No.2 (an example of the present invention), No.9 (an example of the present invention), No.10 (a comparative example) and No.12 (a comparative example), respectively. On the other hand, solid dispersed dyes other than the above were prepared under the following conditions: that is, 21.7 ml of water, 3 ml of a 5% solution of sodium p-octylphenoxyethoxyethoxyethanesulfonate and a 5% aqueous solution of p-octylphenoxypolyoxyethylene ether (degree of polymerization 10) were placed in a pot mill of 700 ml. Thereafter, 5.0 g of dye ExF-2 (or ExF-3, ExF-4) and 500 ml of zirconium oxide beads (diameter 1 mm) were added to the mill, and the content of the mill was dispersed for 2 hours. For the dispersion, the same apparatus as in Example 1 was used. After dispersion the content was taken out from the mill, and filtered to remove the beads. To a resultant filtrate, 8 g of a 12.5% aqueous gelatin solution was added, to obtain a gelatin dispersion of the dye.

The physical stability of the coating solution for yellow filter layer of the 12th layer was evaluated by the method described below. The filtration amount of sample coating solution per a given period of time before and after storage for 2 weeks under the high humidity conditions of 60% RH at 40° C., was measured using a filter, FG 30 (hole size 30 μm, 10 inches), trade name, manufactured by Fuji Photo Film Co., Ltd. Relative values are shown in Table 2, assuming that the filtration amount of a coating solution for yellow filter layer of Sample 101 before the storage be 100. Further, said coating solution for yellow filter layer was singly coated on a PET base, and then absorption spectrum of the resultant coating film was measured and also the presence of comet with nucleus (lumps) occurring in the coating film was visually determined. Relative values are shown in Table 3, assuming that absorbance (absorption maximum wavelength λ max) of a coating film formed with a coating solution for yellow filter layer of Sample 101 before the storage be 100.

TABLE 2

| Coating solution for yellow filter layer | Amount of filtrate | Absorbance | Presence of comet with nucleus occurred | Dispersion method |
|---|---|---|---|---|
| Sample 101 (Before storage) | 100 | 100 | None | Example of this invention No. 1 |
| Sample 101 (After storage) | 101 | 99 | None | Example of this invention No. 1 |
| Sample 102 (Before storage) | 103 | 103 | None | Example of this invention No. 2 |
| Sample 102 (After storage) | 102 | 103 | None | Example of this invention No. 2 |
| Sample 103 (Before storage) | 101 | 99 | None | Example of this invention No. 9 |
| Sample 103 (After storage) | 100 | 100 | None | Example of this invention No. 9 |
| Sample 104 (Before storage) | 93 | 93 | None | Comparative example No. 10 |
| Sample 104 (After storage) | 91 | 93 | None | Comparative example No. 10 |
| Sample 105 (Before storage) | 92 | 91 | None | Comparative example No. 12 |
| Sample 105 (After storage) | 92 | 90 | None | Comparative example No. 12 |

TABLE 3

| Sample No. | Color reproduction (hue index) | Raw stock storability Under high humidity | Latent image storability |
|---|---|---|---|
| 101 (Example of this invention) | 96 | −0.03 | −0.03 |
| 102 (Example of this invention) | 95 | −0.03 | −0.02 |

TABLE 3-continued

| Sample No. | Color reproduction (hue index) | Raw stock storability Under high humidity | Latent image storability |
|---|---|---|---|
| 103 (Example of this invention) | 96 | −0.02 | −0.03 |
| 104 (Comparative example) | 88 | −0.07 | −0.06 |
| 105 (Comparative example) | 89 | −0.07 | −0.07 |

Development processing and other tests were carried out according to the same manner as in Example 1 of JP-A-11-38568.

As is apparent from the above Table 1 demonstrating the results of Example 1, when the dye (D-1) which was to be dispersed, was dispersed with a dispersant defined in the present invention, a dispersion with excellent dispersibility could be obtained, irrespective of addition method thereof. Further, it is found with respect to the dispersion stability that when the dye was dispersed with said dispersant, the dispersion stability was very high, because the change of the degree of dispersion with the lapse of time was little and no sedimentation was observed. Further, as is apparent from Table 2 demonstrating the results of Example 2, when the dispersant defined in the present invention was used, absorbance of the yellow filter layer was quite high and the ease of production was also high. Further, as is apparent from the results demonstrated in Table 3, it is found that the silver halide photographic light-sensitive material of the present invention was excellent in not only color reproduction, but also both raw stock storability and latent-image stability.

As is apparent from the results demonstrated in Table 1, Sample No.12 (comparative example) exhibited sufficient properties in Example 1, whereas the same sample showed insufficient properties (effects) in the tests of Example 2. That is, Sample No.12 exhibited lower absorbance and filtration property than those of the samples according to the present invention and further Sample No.12 resulted inferior in both storability and color reproduction, compared to the samples according to the present invention.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material, comprising a support and provided thereon at least one light-sensitive silver halide emulsion layer and at least one hydrophilic colloidal layer comprising a solid particle dispersion of a water-insoluble photographically useful compound, said solid particle dispersion being a dispersion comprising both a water-insoluble photographically useful compound represented by formula 1 and a polymer represented by formula 2:

formula 1

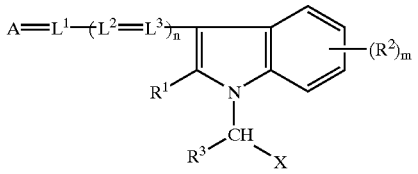

wherein, in formula 1, A represents an acidic nucleus; $L^1$, $L^2$ and $L^3$ each represent a methine group which may be substituted; $R^1$ and $R^3$ each represent a hydrogen atom or a substituent (including an atom), $R^2$ represents a substituent (including an atom), n represents 0 or 1, m represents an integer of 0 to 4, and when m is an integer of 2 to 4, $R^2$'S may be the same or different; and X represents an electron-withdrawing group having Hammett's substitution constant σm of 0.3 to 1.5:

formula 2

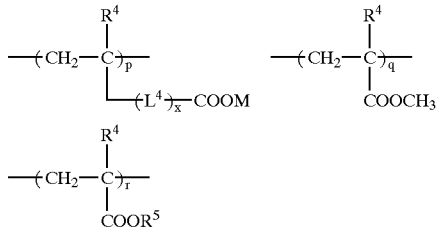

wherein, in formula 2, $R^4$'s each independently represent a hydrogen atom or an alkyl group having 1 to 6 carbon atoms, $R^5$ represents a substituted or unsubstituted alkyl group having 2 to 18 carbon atoms, a substituted or unsubstituted aralkyl group having 7 to 12 carbon atoms, or a substituted or unsubstituted aryl group having 6 to 18 carbon atoms, $L^4$ represents a divalent linking group, x represents 0 or 1, M represents a monovalent cationic group, p represents 2 to 90% by weight, q represents 5 to 80% by weight, and r represents 0 to 60% by weight, with the proviso that p+q+r=100 (wt %).

2. The silver halide photographic light-sensitive material as claimed in claim 1, wherein said solid particle dispersion is a solid particle dispersion in which, after dispersing the water-insoluble photographically useful compound represented by formula 1, the polymer represented by formula 2 is added thereto.

3. The silver halide photographic light-sensitive material as claimed in claim 2, wherein said solid particle dispersion is a solid particle dispersion in which, after dispersing the water-insoluble photographically useful compound with a polymer represented by formula 3, the polymer represented by formula 2 is added thereto:

formula 3

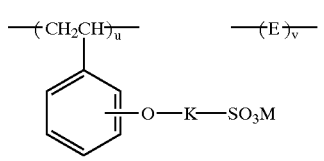

wherein K represents a divalent aliphatic linking group having 1 to 50 carbon atoms, M represents a monovalent cationic group, E represents a repeating unit derived from a copolymerizable ethylenically unsaturated monomer, u represents 5 to 100 mol %, and v represents 0 to 95 mol %.

4. The silver halide photographic light-sensitive material as claimed in claim 1, wherein, in formula 1, the acidic nucleus represented by A is derived from 5-pyrazolone, isooxazolone, barbituric acid, thiobarbitunic acid, pyrazolopyridone, rhodanine, hydantoine, thiohydantoine, oxazolidinedione, pyrazolidinedione, indanedione, hydroxypyridone, 1,2,3,4-tetrahydroquinoline-2,4-dione, or 3-oxo-2,3-dihydrobenzo[d]thiophene-1,1-dioxide, and the acidic nucleus represented by A has at least one carboxyl group, the electron-withdrawing group represented by X is an alkoxycarbonyl group or a cyano group, the methine group represented by each of $L^1$, $L^2$ and $L^3$ is unsubstituted, n is 0, $R^1$ is a hydrogen atom, or a group selected from the group consisting of an alkyl group, an aryl group, an alkoxycarbonyl group, and an aryloxycarbonyl group, m is 0, 1 or 2, when m is 1 or 2, $R^2$ is selected from the group consisting of an alkyl group, an aryl group, an amino group, an alkoxy group, an acyloxy group, a carbamoyl group, a halogen atom, a nitro group, and an carbonyl group, and $R^3$ is a halogen atom, or selected from the group consisting of an alkyl group and an aryl group.

5. The silver halide photographic light-sensitive material as claimed in claim 1, wherein, in formula 2, $R^4$ represents a hydrogen atom or a methyl group, $R^5$ represents n-butyl, n-hexyl, n-octyl, n-nonyl, lauryl, 2-hydroxyethyl, benzyl, phenyl, 4-methylphenyl, or 4-methoxyphenyl, $L^4$ represents $—COOCH_2CH_2—$, $—CONHCH_2CH_2CH_2—$, $—CONHCH_2CH_2CH_2CH_2CH_2—$, or $—CONHC_6H_4—$, x is 0, M represents a monovalent cation of hydrogen, sodium, potassium, lithium, or ammonium, p is 2 to 85% by weight, q is 5 to 75% by weight, and r is 0 to 55% by weight.

6. The silver halide photographic light-sensitive material as claimed in claim 5, wherein, in formula 2, p is 2 to 80% by weight, q is 5 to 70% by weight, and r is 0 to 50% by weight.

7. The silver halide photographic light-sensitive material as claimed in claim 1, wherein the molecular weight of the polymer represented by formula 2 is 1,500 to 150,000, in terms of weight-average molecular weight (Mw).

8. The silver halide photographic light-sensitive material as claimed in claim 7, wherein the molecular weight of the polymer represented by formula 2 is 2,000 to 100,000, in terms of weight-average molecular weight (Mw).

9. The silver halide photographic light-sensitive material as claimed in claim 3, wherein, in formula 3, K represents a propylene group, a butylene group, an alkyleneoxy group, a polyalkyleneoxy group, or an alkylene-alkyleneoxy group, M represents a monovalent cation group of hydrogen, sodium, potassium, lithium, or ammonium, E represents a unit derived from styrene, vinyltoluene, acetoxystyrene, t-butoxystyrene, bromostyrene, chlorostyrene, or hydroxystyrene, u is a value in the range of 15 to 100 mol %, and v is a value in the range of 0 to 85 mol %, and wherein the molecular weight of the polymer represented by formula 3 is from $10^3$ to $10^5$, in terms of weight-average molecular weight (Mw).

10. The silver halide photographic light-sensitive material as claimed in claim 9, wherein, in formula 3, u is a value in the range of 20 to 100 mol % and v is a value in the range of 0 to 80 mol %, and where in the molecular weight of the polymer represented by formula 3 is from 2,000 to $3\times10^4$, in terms of weight-average molecular weight (Mw).

* * * * *